US005498455A

United States Patent [19]

Roberts

[11] Patent Number: 5,498,455

[45] Date of Patent: Mar. 12, 1996

[54] PRECISION ADHESIVE MOUNT APPARATUS AND METHOD EMPLOYING RELEASE SHEET

[76] Inventor: Stuart W. Roberts, M.P.O. Box 4321, Vancouver, B.C., Canada, V6B 3W8

[21] Appl. No.: 35,931

[22] Filed: May 24, 1993

[51] Int. Cl.[6] ..... G09F 1/10

[52] U.S. Cl. ..... 428/40; 40/158.1; 428/41; 428/42; 428/121; 428/124; 428/192; 428/202; 428/203; 428/204; 428/220; 428/354; 428/904.4; 428/913.3; 428/914

[58] Field of Search ..... 428/40, 41, 42, 428/121, 124, 192, 202, 203, 204, 220, 354, 904.4, 913.3, 914; 40/158.1

[56] References Cited

U.S. PATENT DOCUMENTS

| | | | |
|---|---|---|---|
| 279,490 | 6/1883 | Lane | 277/128 |
| 816,870 | 4/1906 | Markoff | 229/92.8 |
| 1,031,521 | 7/1912 | Cameron | 446/147 |
| 1,261,133 | 4/1918 | Kidd | 410/22 |
| 2,256,399 | 9/1941 | MacHarg | 88/26 |
| 2,262,400 | 11/1941 | Laws | 40/125 |
| 2,360,916 | 10/1944 | Trott | 46/35 |
| 2,504,332 | 4/1950 | Horwitt | 40/158 |
| 2,547,359 | 4/1951 | Bacharach | 46/35 |
| 2,598,755 | 6/1952 | Birch | 40/158 |
| 2,603,899 | 7/1952 | Leander | 40/125 |
| 2,737,745 | 3/1956 | Hartmann | 40/158 |
| 2,878,607 | 3/1959 | Alves | 40/158 |
| 2,896,351 | 7/1959 | Johnson | 40/158 |
| 2,956,703 | 10/1960 | Royal | 216/62 |
| 2,984,922 | 5/1961 | Ladenburger | 40/159 |
| 3,114,208 | 12/1963 | Wellman | 33/184.5 |
| 3,153,868 | 10/1964 | Jones | 428/40 |
| 3,266,714 | 8/1966 | Heuberger | 229/92.8 |
| 3,341,961 | 9/1967 | Shanks | 40/158 |
| 3,381,402 | 5/1968 | Ohfuji | 40/158 |
| 3,442,041 | 5/1969 | Morgan | 40/158 |
| 3,503,835 | 3/1970 | Hermann | 161/38 |
| 3,505,140 | 4/1970 | Dunn | 156/249 |
| 3,517,106 | 6/1970 | Chase | 159/249 |
| 3,687,770 | 8/1972 | Chase | 156/221 |
| 3,713,238 | 1/1973 | Hyman | 40/158 |
| 3,810,324 | 5/1974 | Hart | 40/158 R |
| 3,822,495 | 7/1974 | Ohfuji | 40/158 |
| 3,847,325 | 11/1974 | Nasalski | 229/92.8 |
| 3,893,252 | 2/1975 | Chase | 40/158 R |
| 3,921,319 | 11/1975 | Styers | 40/10 R |
| 3,987,569 | 10/1976 | Chase | 40/158 R |
| 4,008,852 | 2/1977 | Davis | 229/92.3 |
| 4,057,923 | 11/1977 | Chase | 40/158 R |
| 4,079,881 | 3/1978 | Sabb | 229/92.8 |
| 4,140,565 | 2/1979 | Parker | 156/219 |
| 4,231,833 | 11/1980 | Lieberman | 156/249 |
| 4,332,095 | 6/1982 | Tanney | 40/158 R |
| 4,378,647 | 4/1983 | Stancato | 40/158 R |
| 4,531,316 | 7/1985 | Farnum | 40/159 |
| 4,622,769 | 11/1986 | Friedman | 40/152.1 |
| 4,624,875 | 11/1986 | Watanabe | 428/41 |

(List continued on next page.)

FOREIGN PATENT DOCUMENTS

| | | | |
|---|---|---|---|
| 985901 | 3/1976 | Canada | 40/61.5 |

*Primary Examiner*—Nasser Ahmad
*Attorney, Agent, or Firm*—Oyen Wiggs Green & Mutala

[57] ABSTRACT

The present invention provides a means and method for securing objects onto mounts such as cards, windows, cones, columns and the like. The adhesive mount incorporates the use of pressure-sensitive adhesive covered by at least one release sheet. The release sheets are made of a thin and flexible material which can be rolled and peeled back upon itself. Guiding elements in some embodiments are supplied on the release sheet. In other embodiments the shape of the release sheet guides the object relative to the mount. In still other embodiments, a template is temporarily adhered onto the mount. In still other embodiments guiding elements may be omitted. The adhesive may be supplied on either or both the object or the mount. The adhesive is covered by a minimum of one release sheet. Each release sheet has a tab, a edge, or a handle for removal. These tabs, edges, or handles extend out from behind, beneath, and beyond the perimeter of the object.

29 Claims, 9 Drawing Sheets

U.S. PATENT DOCUMENTS

| | | | |
|---|---|---|---|
| 4,771,557 | 9/1988 | Bowman | 40/158.1 |
| 4,777,746 | 10/1988 | Brooks | 40/152.1 |
| 4,807,807 | 2/1989 | Glick | 229/92.8 |
| 4,825,572 | 5/1989 | Robbins | 40/152.1 |
| 4,885,854 | 12/1989 | Brandes | 40/152.1 |
| 4,905,389 | 3/1990 | Bisconti | 40/152.1 |
| 4,914,842 | 4/1990 | Lieberman | 40/158.1 |

FIG. 1
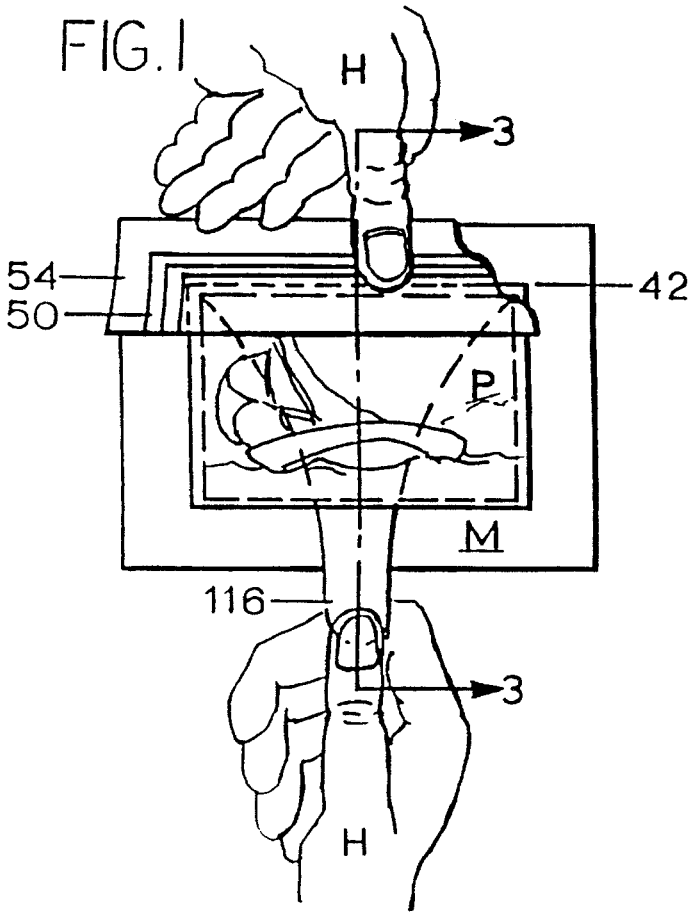
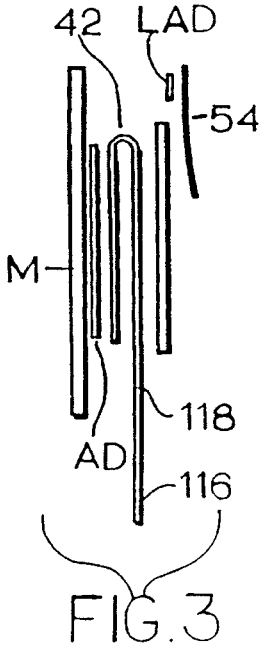
FIG. 3
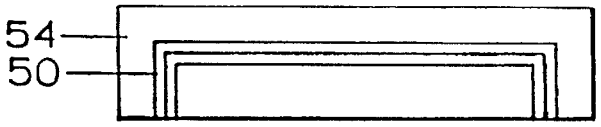
FIG. 5A
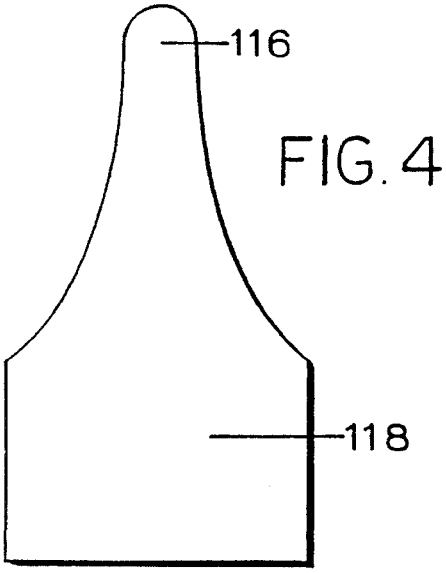
FIG. 4
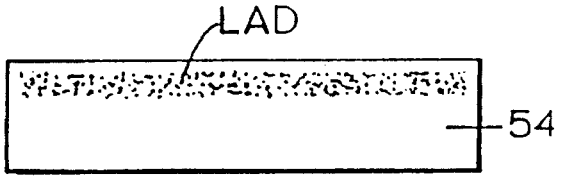
FIG. 5B FIG. 6A
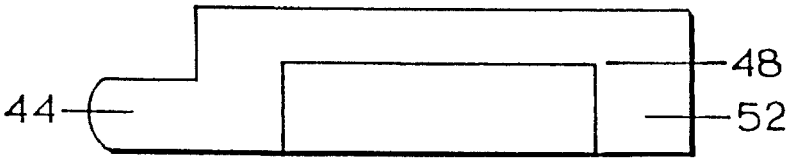
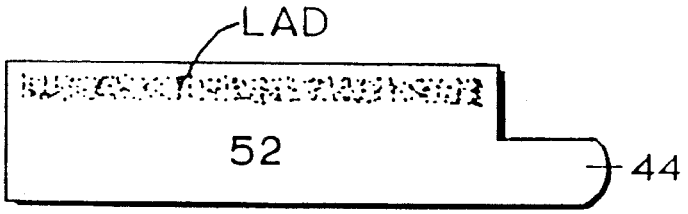
FIG. 6B
FIG. 7A
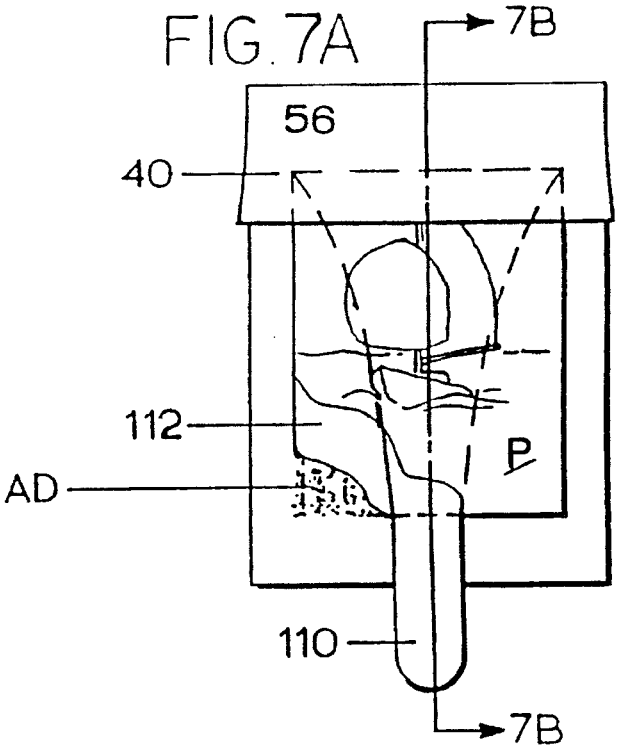
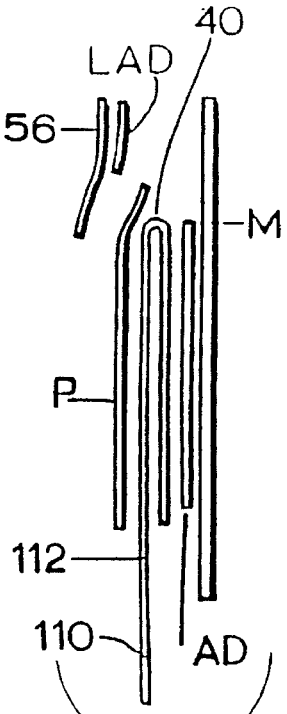
FIG. 7B

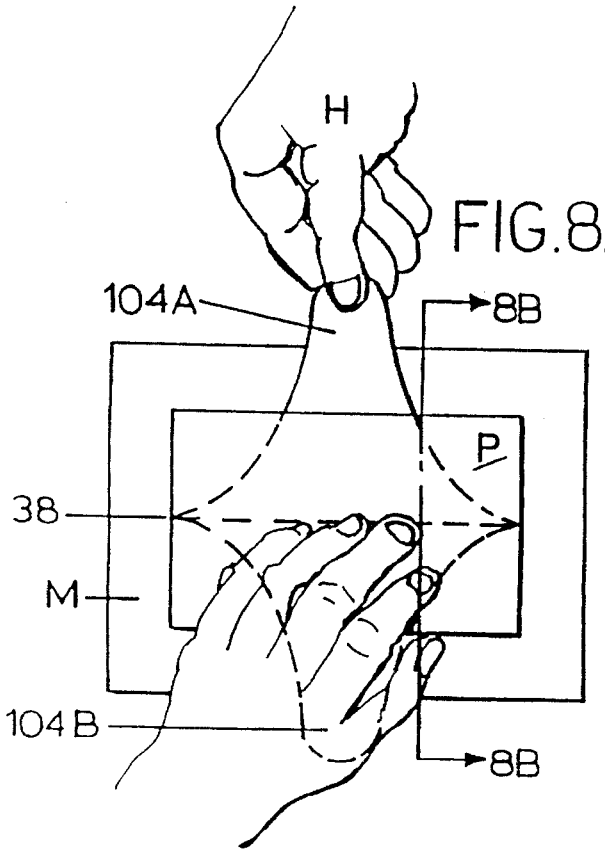
FIG.8A
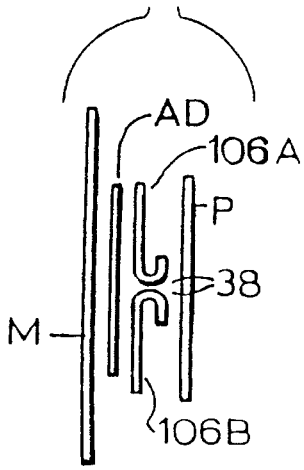
FIG.8B
FIG.9A
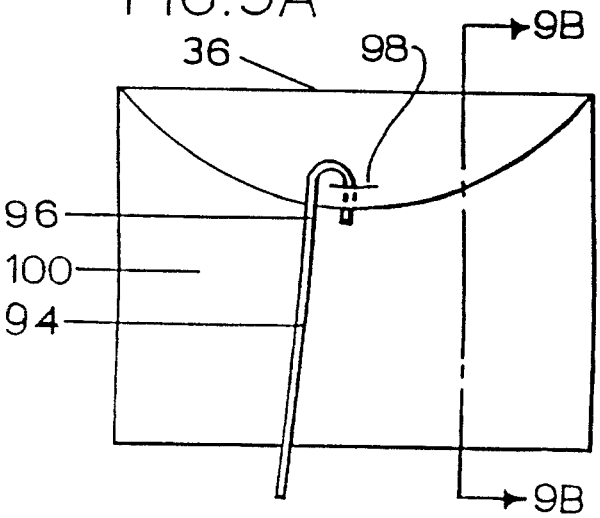
FIG.9B
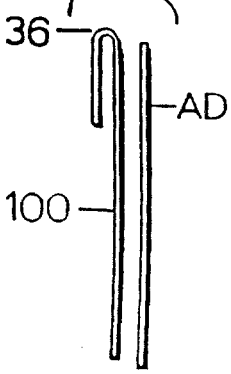

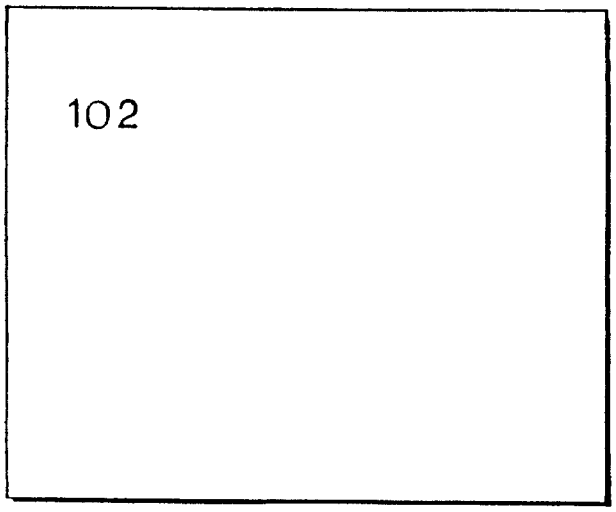
FIG.9C
FIG.10A
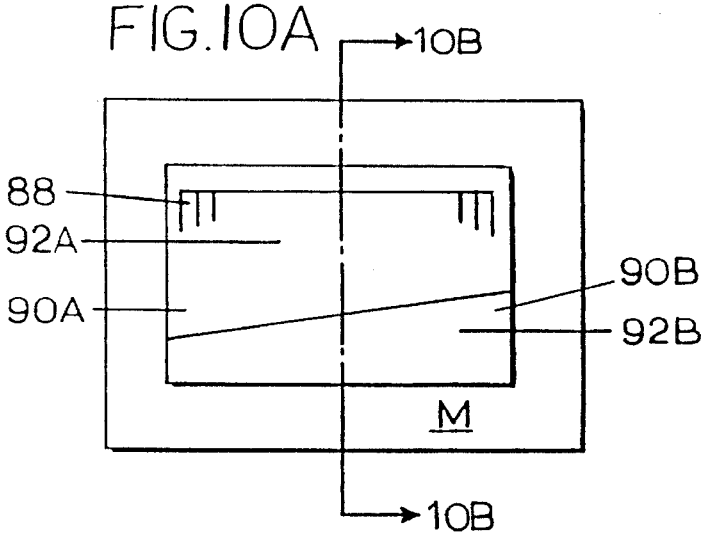
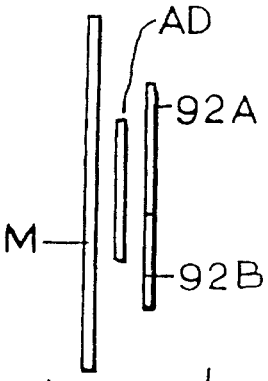
FIG.10B
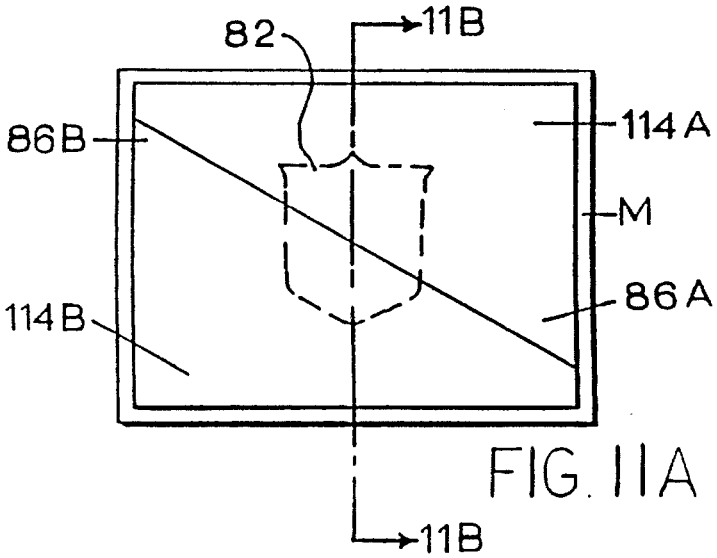
FIG.11A
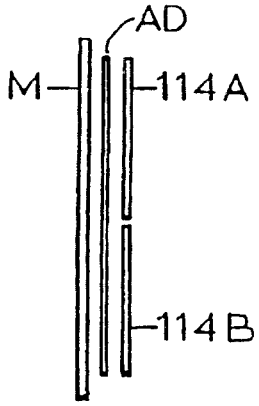
FIG.11B FIG. 12A
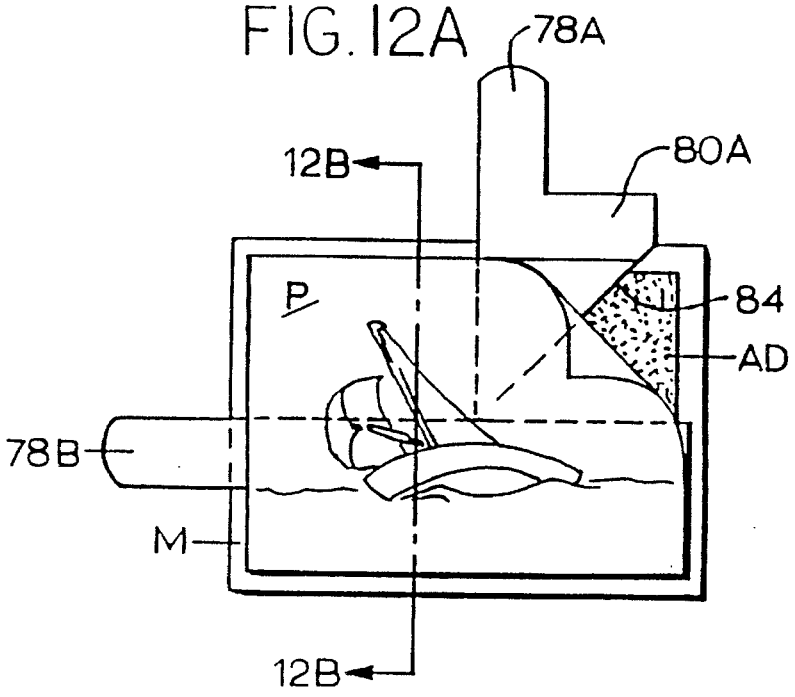
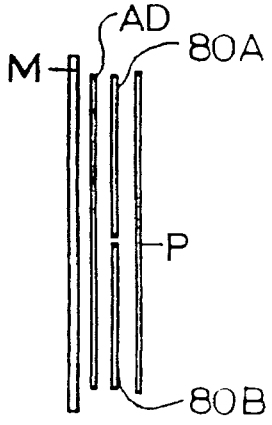
FIG. 12B
FIG. 13
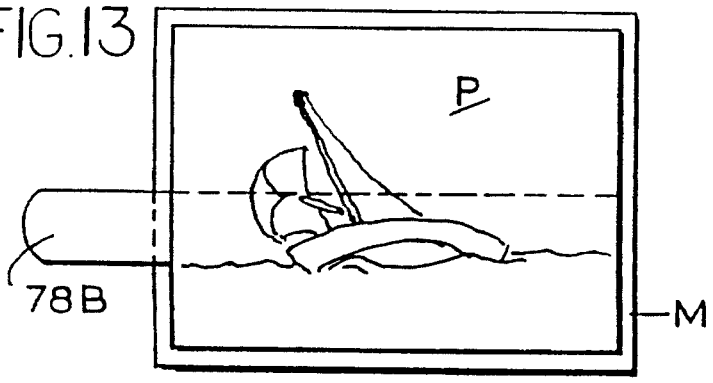

FIG. 17A
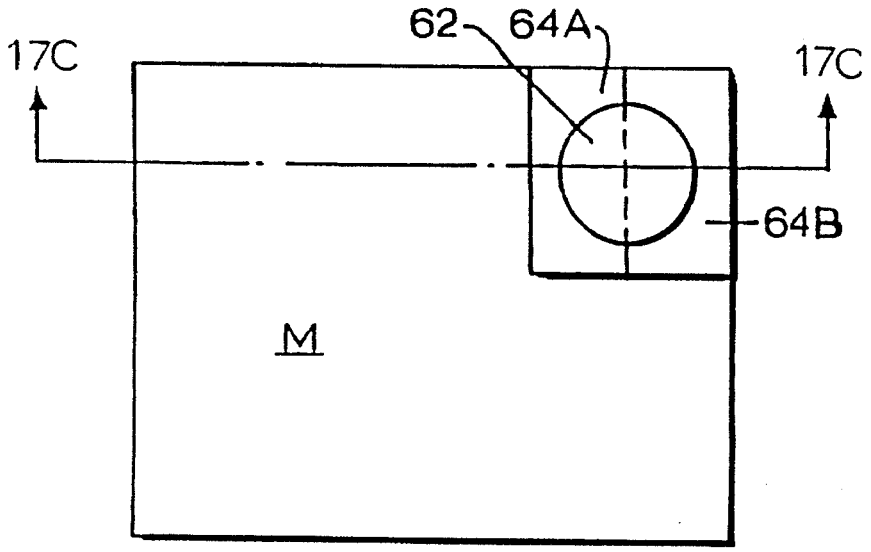
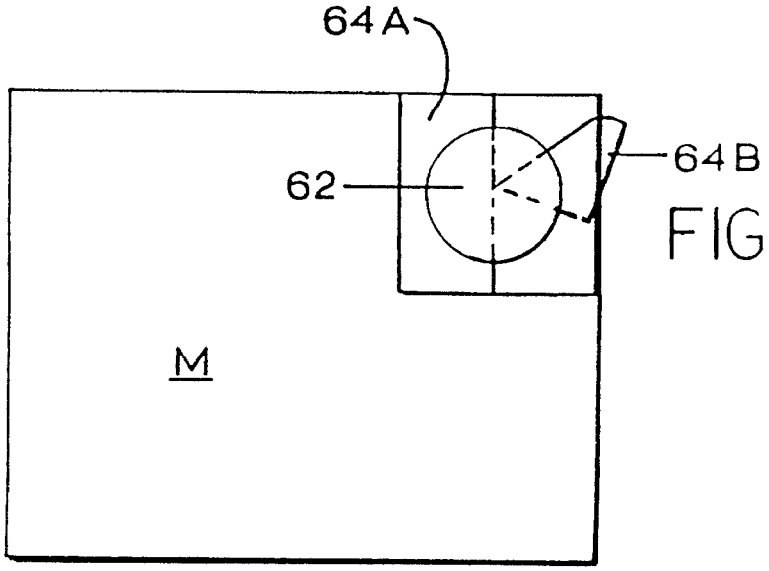
FIG. 17B
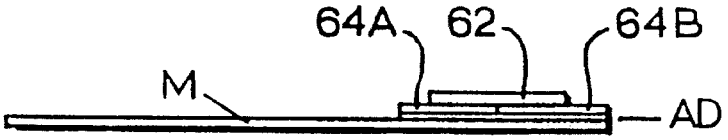
FIG. 17C

PRECISION ADHESIVE MOUNT APPARATUS AND METHOD EMPLOYING RELEASE SHEET

BACKGROUND

1. Field of Invention

This invention relates to adhesive mounts; specifically to pressure-sensitive adhesive mounts which are covered, protected, and isolated by release sheets.

2 Description of Prior Art

Heretofore, many methods have been devised for adhering objects, such as; decals, utility hooks, labels, pictures, and wall paper onto mounts, supports, columns, cones, mats, windows, and boards.

While liquid adhesives can be used, they are messy, frequently damage moisture-sensitive products, tend to warp paper products, tend to mar pictures, tend to drip or run when used on vertical surfaces, and take time to dry.

Pressure-sensitive adhesives have been used, but require considerable skill to ensure accurate placement of the object on the adhesive. Failure to accurately position the object on the adhesive requires delicate corrective measures. Accidental contact with the adhesive is difficult to remedy. Also, accidental contact often results in damage to the adhesive, the object, the mount or any combination of the three.

A picture mount is shown in patent 3,517,106 to Chase (1970) which attempted to address this problem with the use of thick sheets of release paper overlying an adhesive on a picture mount. This mount was designed so that one or more release sheets could be removed to expose sections of adhesive. A picture was then placed upon the remaining thick release sheets, By virtue of their thickness the picture should not have contacted the adhesive. The picture was then moved about on top of the remaining thick release sheets until accurately located. Accurate location was found by referring to guide lines on the release sheets. The picture was then pressed down to contact the exposed adhesive. To remove the remaining thick release sheet sections, the portion of the picture which did not adhere was bent away from the mount. The thick release sheet sections were then grasped and pulled off the mount. The remaining unadhered portions of the picture were then pressed down to contact the adhesive.

This approach had several disadvantages. Most notably, it was unsatisfactory for mounting photographs since photographs possess different characteristics from many other types of pictures. Photographs tend to curl backwards during processing due to the shrinking of the photographic paper but not its emulsion coating. Even when positioned face up upon a flat surface, the photograph will remain curled because the backside of the photographic paper has shrunk more than the front side containing the emulsion coating.

If the mount is of the type which is designed to have one of the end release sheet sections removed first, the end of the photograph overhanging the exposed adhesive will bend backwards. Unless the release sheet is very thick, the photograph will bridge the distance between the plane of the release sheet and the plane of the adhesive. Positioning a photograph on release sheets of this type of mount will require very thick release sheets to prevent accidental contact with the exposed adhesive. When the photograph is pressed down to contact the exposed adhesive, it is forced to bridge the gap between the plane of the thick release sheet and the plane of the exposed adhesive. This bridging repositions the photograph relative to the mount up toward the position of the remaining release sheet. This diminishes the accuracy of the photograph's final mounted position.

A variation on the above mount requires the removal of a central release sheet section prior to placing a picture upon it. The adhesive web beneath is exposed with the removal of this central release sheet section. The photograph is placed upon the remaining thick release sheet sections. The photograph is moved about to position as desired. The area of the photograph overlying the exposed adhesive is then subjected to digital pressure so that the photograph is forced down between the remaining thick release sheet sections, pressing it into contact with the exposed adhesive. The ends of the photograph are then bent away from the mount. The ends of the thick release sheet sections are then grasped and pulled up off the mount.

These picture mounts and the procedures for using them have several disadvantages:

(a) The photograph in this type of mount is subjected to digital pressure as it is forced down into contact with the exposed adhesive. Digital pressure commonly mars the surface of the photograph.

(b) The bending of the photograph while pushing it into contact with the adhesive stretches the paper and mars the surface of the photograph.

(c) The remaining thick release sheet sections are removed. The unadhered end of the photograph is grasped and bent sharply away from the mount to facilitate removal of the thick release sheets. This bending back of the photograph further subjects the photograph to damaging forces.

(d) All of these types of mounts are unnecessarily complex, and use excessive amounts of materials which increase weight, cost, and waste.

(e) Guide lines are usually included on the release sheets. The guide lines are intended to assist the user in accurate placement of the photograph on the remaining release sheet sections. This approach is useful, but requires extreme accuracy in the placement of these release sheets relative to the mount. The extreme accuracy needed to position the release sheet containing the guide lines, makes assembly of this type of mount difficult.

(f) Under certain circumstances, a release sheet will shift relative to the mount. This shifting can occur because of a shearing force which slides it over the surface of the adhesive, or because the adhesive runs or shifts. In these situations, this type of mount is impractical.

(g) The use of opaque release sheets can obscure and distract from accurate placement of the picture on the mount.

Objects and Advantages

Accordingly, several objects and advantages of my invention are:

(a) to provide a simple, inexpensive adhesive mount and a method enabling unskilled users to use the same, (b) to provide an adhesive mount and a method for mounting pictures, photographs, two-dimensional, perspective illustrations and the like, which overcome the difficulties of the previously mentioned mounts, (c) to provide an adhesive mount and a method which provides greater accuracy in the positioning and adhesion of objects to mounts, (d) to provide an adhesive mount and a method for unskilled persons to accurately position and adhere photographs of varied sizes to prepared mounts, (e) to provide guiding elements on the mounts which identify appropriate locations for positioning photographs of slightly varied sizes, and (f) to provide an adhesive mount and method for mounting pictures and the like which does not damage pictures by bending and warping them.

Other objects and advantages are:

(g) to provide an adhesive mount on which an object can be accurately located prior to exposing an adhesive, (h) to provide an adhesive mount with mounting materials which will not visually obscure or distract from accurate placement of an object on a mount, (i) to provide an adhesive mount with mounting materials which will not distract from the aesthetics of the mount, (j) to provide a greeting card or post card which will enhance the aesthetics of a photograph while presenting the consumer with a professional yet personalised greeting card or post card, (k) to provide a greeting card or postcard which will emphasize the pictures adhered to them, (l) to provide a greeting card or postcard which utilizes textured paper, (m) to provide a greeting card or postcard which will not become obsolete as the technology of personal computers and video disk cameras is intertwined, making the reproduction and manipulation of photographs increasingly accessible to the general public, (n) to provide a product which will fulfill the consumers' needs while increasing point of purchase sales of photo finishing products and services, (o) to provide an adhesive and a covering release sheet which will allow the viewing of material beneath them, (p) to provide an adhesive and a release sheet which allow the viewing of instructions, illustrations, symbols or other illustrations beneath the adhesive and the release sheet, whereby the need for separate instructions and their additional expenses is reduced, and (q) to provide the materials and a method for adhering objects to mounts.

Other objects and advantages will become apparent from the ensuing specifications and drawings.

BRIEF DESCRIPTION OF THE DRAWINGS

In the drawings, closely related figures have the same number but different alphabetic suffixes, e.g., FIGS. 5A and 5B are closely related. Different parts with identical functions have the same number, but different alphabetic suffixes. The same alphabetic letters are used for each set of components which are consistently used throughout the figures for identical purposes and properties. E.g., AD for high tack adhesive, M for mount, P for picture.

FIG. 1 shows a front view of a picture mount with a picture in the horizontal position resting under the edge of a template and overlying a release sheet in accordance with the invention.

FIG. 3 shows an exploded section 3—3 of the mount of FIG. 1.

FIG. 4 shows the release sheet of the mount of FIG. 1, unfolded.

FIG. 5A shows a front view of the template of FIG. 1.

FIG. 5B shows a rear view of the template of FIG. 1.

FIG. 6A shows an alternative template equipped with a tab for easy removal.

FIG. 6B shows a rear view of the template of FIG. 6A.

FIG. 7A shows a front view of a picture mount like the picture mount of FIG. 1 with a picture in the vertical position resting under the edge of a template and overlying a release sheet in accordance with the invention.

FIG. 7B shows an exploded section 7B—7B of the mount of FIG. 7A.

FIG. 8A shows a front view of a picture mount with a picture in the horizontal position overlying two release sheets both release sheets of which are like the release sheet of FIG. 1.

FIG. 8B shows an exploded section 8B—8B of the mount of FIG. 8A.

FIG. 9A shows a front view of a release sheet having a folded back section and a hook and handle device attached to this, which serves the same purpose as the tab on the release sheet of FIG. 1.

FIG. 9B shows an exploded section 9B—9B of the release sheet of FIG. 9A.

FIG. 9C shows a front view of a backing release sheet used to protect, and isolate the adhesive layer supplied on the release sheet of FIG. 9A.

FIG. 10A shows a front view of a picture mount with an adhesive layer covered by a release sheet cut diagonally into two sections, the top section of which contains guide lines.

FIG. 10B shows an exploded section 10B—10B of the mount of FIG. 10A.

FIG. 11A shows a front view of a picture mount with a crest visible beneath a transparent adhesive layer covered by a transparent release sheet similar to the release sheet of FIG. 10A.

FIG. 11B shows an exploded section 11B—11B of the mount of FIG. 11A.

FIG. 12A shows a front view of a picture mount with a picture overlying two alternate styles of release sheets sections each of which has a tab protruding from the side for easy removal.

FIG. 12B shows an exploded section 12B—12B of the mount of FIG. 12A.

FIG. 13 shows a front view of part of the picture mount of FIG. 12A with the picture adhered to the top section.

FIG. 17A shows a rear view of a decal equipped with a layer of adhesive on its face, overlying two flexible release sheet sections positioned on top of a mount in accordance with the invention.

FIG. 17B shows a rear view of the decal and mount of FIG. 17A with a release sheet partially removed.

FIG. 17C shows a section 17C—17C of the decal and mount of FIG. 17A.

REFERENCE CHARACTERS IN DRAWINGS

Figure 2:
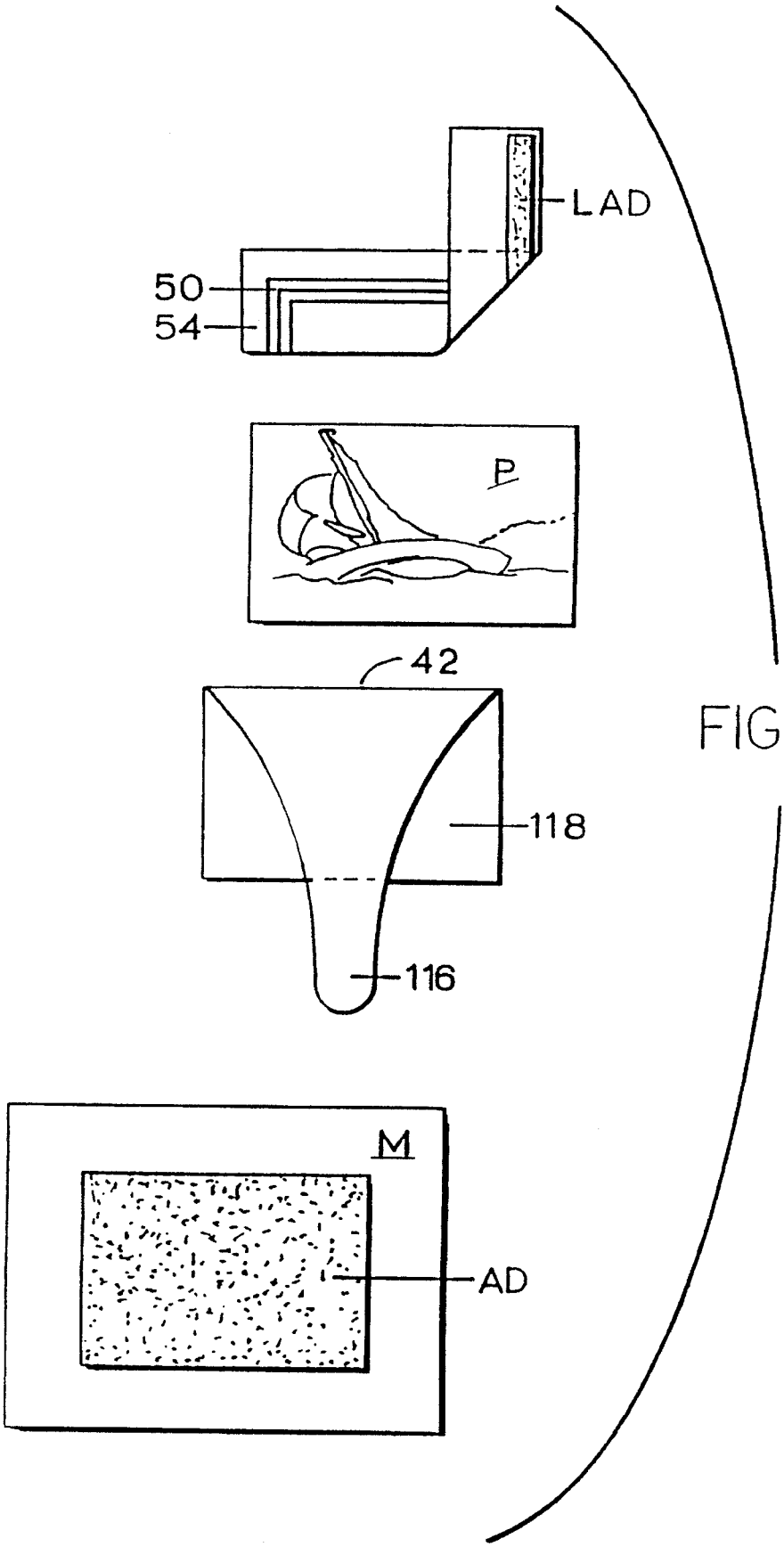
FIG. 2 shows an exploded front view of the mount of FIG. 1.

LAD Light Adhesive
AD Adhesive
H Hand
M Mount
MT Mat
Object
P Picture
30A Fold line
30B Fold line
32A Tab
32B Tab
34A Release sheet
34B Release sheet
36 Fold line
38 Fold line
40 Fold line
42 Fold line
44 Tab
48 Guide lines
50 Guide lines
52 Template/tab
54 Template
56 Template
58 Decal
59A Release sheet dbl back
59B Release sheet dbl back
60A Tab
60B Tab
61 Central Section
62 Decal
64A Release sheet
64B Release sheet
65 Fold line
66 Release sheet
67 Tab
68 Release sheet
69 Tab
70 Release sheet
71 Tab
72 Release sheet
73 Tab
74 Release sheet
75 Tab
76 Release sheet
77 Tab
78A Tab
78B Tab
80A Split Release sheet/Tabs
80B Split Release sheet/Tabs
82 Crest
84 Diagonal line
86A Corner A
86B Corner B
88 Guide lines
90A Corner A
90B Corner B
92A Split Release sheet 60/40
92B Split Release sheet 40/60
94 Handle
96 Hook
98 Perforation
100 Release sheet dbl back
102 Backing release sheet
104A Tab
104B Tab
106A Release sheet 2 dbl back
102B Release sheet 2 dbl back
110 Tab
112 Release sheet dbl back vert
114 A Split sheet/diagonal
114B Split sheet/diagonal
116 Tab
118 Release sheet dbl back FIGS. 1 To 3—Picture Mount.

In accordance with the invention, an adhesive mount is equipped with a layer of pressure-sensitive adhesive covered. This adhesive layer is protected, and isolated by a single release sheet. A picture overlies the release sheet and this picture is positioned under the edge of a template.

FIG. 1 shows a front view of an assembled picture mount in accordance with the invention. The picture mount is shown assembled. The top right hand corner of a template 54 is seen broken away to show mount M below.

Mount M is made of cardboard or heavy paper and is coated with pressure-sensitive adhesive.

Mount M has a rectangular surface approximately 15.2 cm by 20.3 CM, which is made of cardboard. Mount M has a center area 10.1 cm by 15.2 cm, upon which a layer of pressure-sensitive adhesive AD is adhered. Suitable transparent, high tack pressure-sensitive adhesive can be purchased from National Adhesives Singapore. The pressure-sensitive adhesive is covered by a release sheet which is made of polyester and is coated with a release agent, silicone. Release sheet 118 has a first section which covers adhesive AD. The release sheet is folded back along fold line 42 to form a second section which tapers to form a tab.

A template 54 made of a transparent sheet of polyester is printed with guide lines 50 along its bottom edge. The template is a rectangle strip held onto the top of mount M with a strip of light tack pressure sensitive adhesive LAD running along the top edge of the template. The strip of adhesive is approximately one third the width of the template. Template 54 is approximately 20.3 cm long by 4.1 cm wide.

FIG. 2 shows an exploded front view of the mount of FIG. 1. Template 54 is folded upwardly to show a line of light-tack adhesive LAD.

FIG. 3 shows an exploded section 3—3 of the mount of FIG. 1. Mount M includes a layer of pressure-sensitive adhesive AD covered by a thin release sheet 118. Release sheet 118 is folded back upon itself along fold line 42. A release sheet tab 116 extends out from under a picture P. Tab 116 extends beyond the perimeter of picture P. The user's right hand H is holding tab 116 between the thumb and forefinger.

Picture P overlies and is positioned on top of release sheet 118 in a horizontal orientation. The top edge of picture P is under the bottom edge of template 54. Template 54 is made of a relatively thin transparent material. Picture P is positioned within guide lines 50. The thumb of the user's left hand H is pressing down onto template 54. Template 54 is adhered to mount M by a line of light-tack adhesive LAD. The light-tack adhesive is preferably transparent.

FIG. 4—Release Sheet

FIG. 4 shows a front view of release sheet 118 of FIG. 1 as it appears unfolded.

FIGS. 5A and 5B—Template

FIG. 5 shows a front view of template 54 of FIG. 1 and FIG. 5B shows a rear view of template 54 of FIG. 1. Template 54 is made of a transparent material with guide lines 50 visible. Template 54 may be made of polyethylene, polypropylene, polyester, or any other suitable material. Template 54 has light-tack adhesive LAD along its top edge. Light-tack adhesive LAD holds template 54 onto mount M. Light-tack adhesive LAD has similar characteristics to the adhesive used on commonly sold removable adhesive notes, e.g., as produced by the 3M Company and sold under the trademark POST IT. Guide lines 50 are arranged to adjust for minor variations in the longer dimension of picture P. The guide lines are arranged to position three of the four sides of picture P equidistant from three sides of mount M.

FIG. 6A and 6B—Template With Tab

FIG. 6A shows a front view of an alternative style of a template 52 and FIG. 6B shows a rear view of template 52. Template 52 can be used in place of template 54 on the mount of FIG. 1. A tab 44 protrudes out from the side of template 52. A line of light-tack adhesive LAD runs along the top edge. Guide lines 48 are visible on template 52. Template 52 is preferably made of a clear transparent material, although an opaque material can be used.

FIGS. 7A and 7B—Mount With Single Release Sheet

FIG. 7A shows a front view and FIG. 7B shows a exploded section 7A—7A of a mount M which is similar to mount M of FIG. 1.

Mount M includes a layer of pressure-sensitive adhesive AD covering part of its central section. A release sheet 112 is releasably secured to adhesive AD. Release sheet 112 is folded back upon itself at fold line 40, to form a second section. The second section of release sheet 112 extends across the entire length of the first section. The second-section of release sheet 112 tapers to form a tab 110. A picture P overlies release sheet 112. Tab 110 extends out from beneath picture P. Picture P is positioned in a vertical orientation, under the edge of template 56. A light-tack adhesive LAD permanently adhered to template 56 releasably adheres template 56 onto mount M.

FIG. 8A—Mount With Two Release Sheets

FIG. 8A shows a front view of a picture mount M which is different from the previous embodiments in that it uses two release sheets instead of one and does not have a temporary template attached to the mount.

FIG. 8B—Exploded View Of Mount

FIG. 8B shows an exploded section 8B—8B of the picture mount of FIG. 8A. Mount M includes a layer of pressure-sensitive adhesive AD covered by two release sheets 106A and 106B. Release sheets 106A and 106B are releasably secured to adhesive AD. Release sheet 106A is folded back upon itself at fold line 38 and forms a second-section. The second section of release sheet 106A extends across the entire length of the first section and tapers to form tab 104A. Release sheet 106B is folded back upon itself at fold line 38 and forms a second-section. The second section of release sheet 106B extends across the entire length of the first-section and tapers to form tab 104B. A picture P overlies release sheets 106A and 106B. The user's left hand H is holding picture P stationary relative to mount M. Pressure is directed down onto picture P toward mount M. The user's right hand H is shown holding tab 104A between the thumb and forefinger.

FIG. 9A—Release sheet

FIG. 9A shows a front view of a release sheet 100 used to apply an adhesive layer AD onto the surface of either a mount or an object. The adhesive layer remains protected and isolated by release sheet 100.

FIG. 9B—Exploded View Of Release Sheet

FIG. 9B shows an exploded section 9B—9B of the release sheet of FIG. 9A. Release sheet 100 is equipped with a layer of pressure-sensitive adhesive AD which is releasably adhered to release sheet 100. Release sheet 100 is folded back upon itself at fold line 36. Release sheet 100 is thin and flexible. A hook 96 rests on top of release sheet 100. Hook 96 is releasably attached to release sheet 100. Hook 96 is inserted into perforation 98. A handle 94 extends off the end of release sheet 100. Hook 96 is thin and in sheet form. Hook 96 may be made of paper, plastic, wood, or any other suitable material. Hook 96 and handle 94 may be made of the same material. Hook 96 is used in place of a tab as described in the previous embodiments. Hook 96 may be removed from release sheet 100 and reused with other suitable release sheets. Release sheet 100 may be used to apply adhesive AD onto either a mount or a object, such as a picture P. Release sheet 100 may be provided on a backing release sheet 102.

FIG. 9C—Backing Release Sheet

FIG. 9C shows a front view of a backing release sheet 102. Backing release sheet 102 is made of any suitable material, such as a silicone treated paper and is preferably made somewhat stiffer than release sheet 100 of FIG. 9A. Backing release sheet 102 is made to release more readily from the adhesive than release sheet 100. Backing release sheet 102 may be coated with silicone, wax, or any other suitable material which releases from the adhesive more readily than release sheet 100.

FIG. 10A—Mount

FIG. 10A shows a front view of a picture mount M, while FIG. 10B shows a exploded section 10B—10B of FIG. 10A.

Mount M includes a layer of pressure-sensitive adhesive AD. A diagonal cut severs the flexible release sheet into two sections, 92A and 92B. Release sheet sections 92A and 92B cover, protect, and isolate adhesive AD. Release sheet sections 92A and 92B are made of a thin flexible material. Release sheet section 92B is smaller than release sheet section 92A. Release sheet section 92A has guide lines 88 visible thereon. Release sheet section 92A has a corner 90A and release sheet section 92B has corner 90B. Both corners 90A and 90B extends out beyond the perimeter of adhesive AD covering mount M. A picture P of a width smaller than the width of release sheet sections 92A and 92B is used with mount M. A picture P of a size suitable to sit within guide lines 88 is used with mount M. Both corners 90A and 90B extend out and beyond the perimeter of picture P. Both of the corners can be grasped by the user's thumb and forefinger.

FIG. 11A—Mount

FIG. 11A shows a front view of a picture mount M similar to the mount of FIG. 10A, while FIG. 11B shows a exploded section 11B—11B of FIG. 11A.

A crest 82 is printed in the middle of mount M. Mount M includes a layer of transparent, pressure-sensitive adhesive AD. A diagonal cut severs the transparent release sheet into two equal sections, 114A and 114B. Release sheet sections 114A and 114B protect, and isolate the underlying adhesive AD. The release sheet sections are made of a transparent material, such as polyethylene, polypropylene, polyester, or another suitable material. Suitable transparent release sheets can be purchased from Leonard Stace, Cheltenham, United Kingdom. Crest 82 is visible beneath the transparent release sheet sections and the transparent adhesive. Release sheet section 114A has a corner 86A, while release sheet section 114B has corner 86B. Both corners 86A and 86B extend out and beyond the perimeter of adhesive AD. Both of the corners can be grasped by the user's thumb and forefinger.

FIG. 12A—Mount

FIG. 12A shows a front view of an alternative picture mount M equipped with a layer of pressure-sensitive adhesive AD covered by a release sheet. A horizontal cut severs the release sheet into two equal sections, 80A and 80B. Each release sheet section has a tab protruding from its side. The tabs are positioned next to the opposing release sheet section and are unaffected by adhesive AD. Adhesive AD covers the perimeter of mount M beneath release sheet sections, 80A and 80B.

With a picture mount of this type the adhesive can cover the entire surface beneath the release sheet sections. Release sheet section 80A is seen partially removed. It is folded along diagonal line 84 and has a tab 78A protruding from beneath picture P. Release sheet section 80B has a tab 78B protruding from the side of mount M. Release sheet sections 80A and 80B are made of a thin flexible material. In some embodiments the release sheet sections will be transparent while in other embodiments the adhesive will be transparent. Transparent release sheet should be used when consumer information is positioned beneath the release sheet. This information may be printed on the card, the adhesive, or illustrated with specific patterns of a colored or opaque adhesive. A transparent release sheet and a transparent adhesive will be used when consumer information is supplied on a picture mount beneath where the adhesive and release sheet is applied. If no such information is necessary, an opaque release sheet and an opaque adhesive can be used.

When an opaque release sheet is used in the assembly of the picture mount, the color scheme of the release sheets should be compatible with the color scheme of the mount. If several picture mounts having several different colours were assembled with adhesives and release sheets, a clear transparent release sheet can be used with all of the mounts. This will eliminate the need for an inventory of release sheets in various colors compatible with the various colors of the mounts.

A picture P overlies the release sheet sections and is positioned with the edges of the picture aligning the edges of the release sheet. The top right hand corner of picture P is shown curled back.

FIG. 12B—Mount

FIG. 12B shows an exploded section 12A—12A of the picture mount of FIG. 12A.

FIG. 13—Mount With One Release Sheet Removed

FIG. 13 shows a front view of the picture mount of FIG. 12A with release sheet section 80A removed. Picture P is adhered to adhesive AD, exposed by the removal of release sheet section 80A.

FIG. 14—Mount

Figure 14:
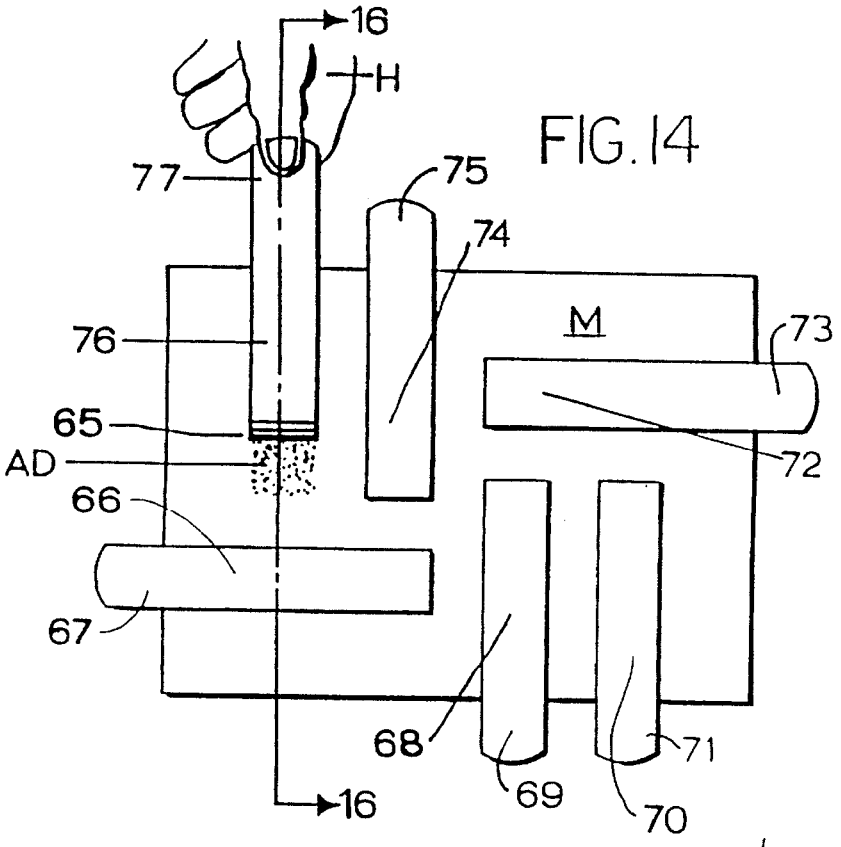
FIG. 14 shows a front view of a mount and mat board containing six release sheets covering six adhesive patches and illustrating removal of a release sheet section covering one of the adhesive patches in accordance with the invention.
Figure 15:
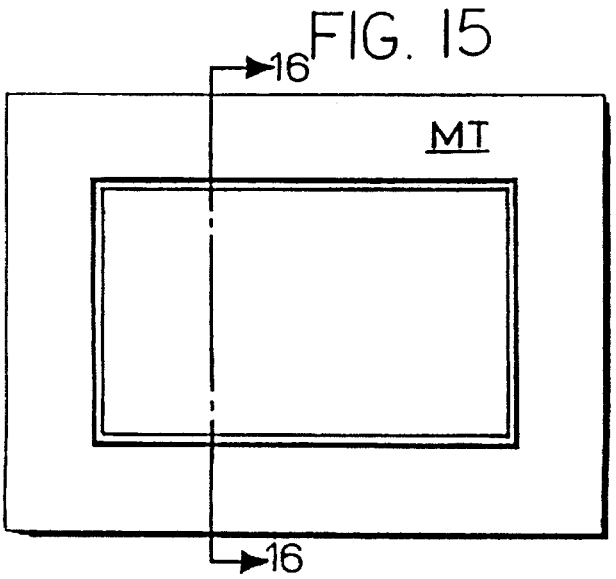
FIG. 15 shows a front view of the mat used with the mount and mat board of FIG. 14.

FIG. 14 shows a front view of a mount M designed to receive a picture P and a mat MT of FIG. 15. Mount M is equipped with six patches of pressure-sensitive adhesive AD. Each patch of adhesive AD is covered by a thin, flexible release sheet. Each release sheet is folded back upon itself to form second sections. Each of the second sections has a tab. Each of the tabs extends beyond the perimeter of mount M. The release sheet sections are 66, 68, 70, 72, 74, 76, and their respective tabs are 67, 69, 71, 73, 75, 77. Tab 77 is held between the thumb and the forefinger of a left hand H. Release sheet 76 has been pulled part way off of mount M, so that part of the adhesive patch is exposed. Release sheet 76 is folded back upon itself, along fold line 65.

FIG. 15—Mat

FIG. 15 shows a front view of a mat MT which is used in conjunction with mount M of FIG. 14. Mat MT is positioned on top of the outside edges of picture P. Picture P lays on top of the release sheets of mount M of FIG. 14. Picture P can be seen through the center cut-out portion of mat MT. The mount of FIG. 14 can be used with a picture P having an outside perimeter the same size as the inside edges of the mat.

Mat MT may be made of any attractive material, e.g. heavy paper, card board, plastic, wood, glass. Mats are commonly made of coloured cardboard.

Figure 16:
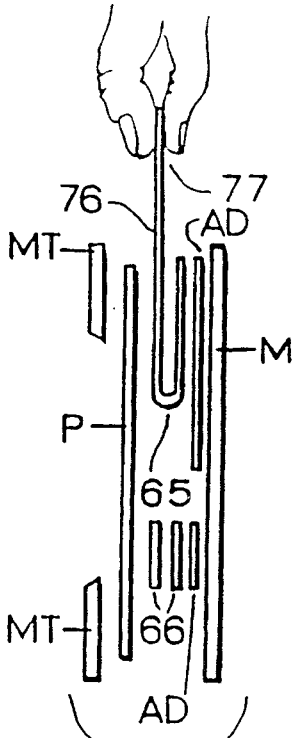
FIG. 16 shows an exploded section 16—16 of the mount of FIG. 14 and the mat of FIG. 15, illustrating the removal of a release sheet from beneath both a picture and the mat.

FIG. 16—Mount And Mat

FIG. 16 shows a exploded section 16—16 of the mount of FIG. 14 and the mat of FIG. 15. Mount M has one patch of adhesive AD partially uncovered by the partial removal of release sheet 76. Tab 77 is held between the thumb and forefinger of a left hand. Release sheet 76 has been pulled part way off mount M. A small area of adhesive AD has been exposed by pulling tab 77. Fold line 65 on release sheet 76 has rolled back toward the outside edge of mount M. The adhesive patch beneath release sheet 66 is shown next to mount M. A picture P overlies release sheet sections 66, 68, 70, 72, 74, and 76 of mount M. Picture P has a outside perimeter slightly smaller than that of mount M. Mat MT of FIG. 15 has a perimeter approximately the same size as mount M of FIG. 14.

FIG. 17A—Decal

FIG. 17A shows a rear view of a decal 62 positioned in the top right hand corner of a mount M. Mount M is a transparent sheet, such as a window. Decal 62 includes a layer of pressure-sensitive adhesive AD secured to the front face. Adhesive AD is covered by two release-sheet sections, 64A and 64B. Release-sheet sections 64A and 64B are approximately the same shape and size. The perimeters, of the release sheet sections assist in locating decal 62 relative to mount M. The top edges of release sheet sections 64A and 64B and the outside edge of release sheet section 64B are shown coincident at the edge of the top righthand corner of mount M. Release sheets 64A and 64B are thin and flexible. Both release sheet 64A and 64B can be bent back upon themselves and peeled out from beneath decal 62.

FIGS. 17B—Decal

FIG. 17B shows a rear view of decal 62 with release sheet 64B folded back upon itself and partially removed. Release sheet 64B is seen peeled and folded partway off adhesive AD on decal 62. Release sheet 64B is folded in the direction of mount M away from decal 62.

FIG. 17C—Decal

FIG. 17C shows a section 17C—17C of FIG. 17A.

FIG. 18—Decal

Figure 18:
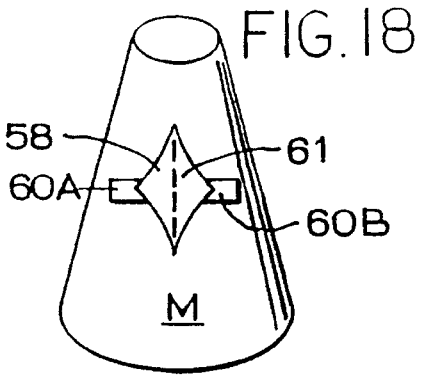
FIG. 18 shows a front view of a decal equipped with a layer of adhesive covered by two release sheets folded back upon themselves and positioned on the side of a mount in the shape of a cone.

FIG. 18 shows a front view of a decal 58 positioned on the side of mount M.

FIG. 19—Decal

Figure 19:
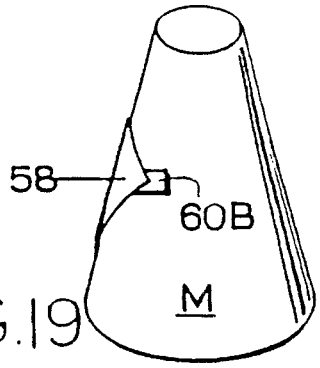
FIG. 19 shows a side view of the decal and mount of FIG. 18.

FIG. 19 shows a side view of a decal 58 positioned on the side of mount M.

Mount M is in the form of a cone, such as is used to warn of hazards. Decal 58 is shown bent and contoured to the surface of mount M. Decal 58 is made of a flexible sheet of material such as paper or plastic. Decal 58 can be used for supplying information about potential hazards, hazardous materials, as well as for identification purposes. Decal 58 is equipped with a layer of pressure-sensitive adhesive AD. Adhesive AD is covered by two release sheets, 59A and 59B. Both release sheets are folded back upon themselves at the decal's central section 61. The folded back portions form second sections, each of which taper to form tabs. These tabs extend across the entire length of the first section and protrude out from under the decal. Release sheet 59A is folded back upon itself and tapers to form tab 60A. Release sheet 59B is folded back upon itself and tapers to form tab 60B.

FIG. 20—Decal

Figure 20:
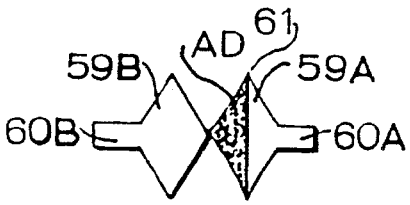
FIG. 20 shows a rear view of the decal of FIGS. 18 with a release sheet removed.

FIG. 20 shows a rear view of decal 58 with release sheet 59B removed from the adhesive layer. Release sheet 59B is positioned beside decal 58, unfolded.

FIG. 21A—Object

Figure 21A:
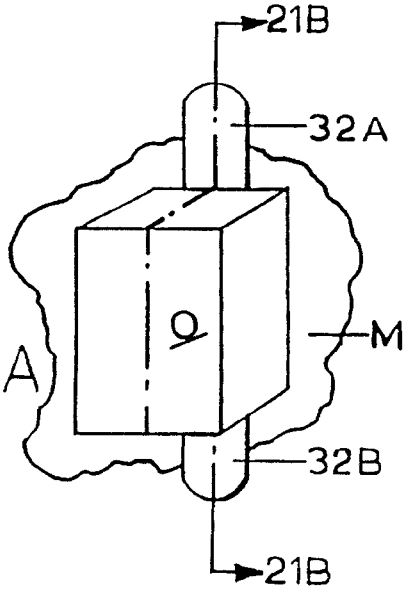
FIG. 21A shows a perspective view from the front of an object equipped with an adhesive layer, covered by two release sheets, positioned on the side of a vertical mount.

FIG. 21A shows a perspective from the front of an object O positioned next to a mount M in a vertical orientation.

FIG. 21B—Object

Figure 21B:
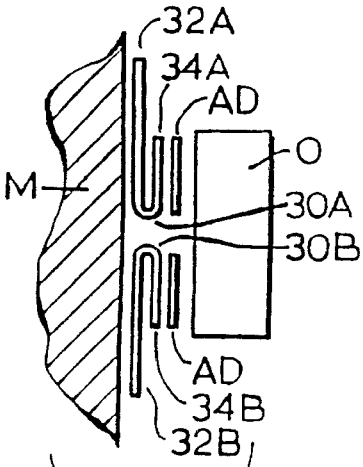
FIG. 21B shows a exploded section 21B—21B of the object and mount of FIG. 21A.

FIG. 21B shows an exploded section 21B—21B of the object and the mount of FIG. 21A. Object O is equipped with a layer of adhesive AD in two patches. Release sheet 34A covers one patch of adhesive AD and folds back upon itself at fold line 30A to form a second section. Release sheet 34A second section tapers to form a tab 32A which extends beyond the perimeter of object O. Release sheet 34B covers the other patch of adhesive AD and folds back upon itself along fold line 30B to form a second section. Release sheet 34B second-section tapers to form a tab 32B. Object O is positioned over the surface of mount M.

Making The Adhesive Mounts

All of the figures and descriptions above show mounts which utilize pressure-sensitive adhesive covered by release sheets. To make the mounts of my preferred embodiment (FIGS. 1 to 7B) the card size is first determined.

For example, if one makes a card intended to adhere a 8.89 cm by 12.70 cm photograph, a good size for each of the cards is 12.70 cm by 16.51 cm. Assuming the photograph was positioned in the center of the card, a border of about 1.91 cm will exist around the perimeter of the photograph. The cards can be printed with graphics by way of offset printing. The cards are printed in sheets, which are later cut to size. The adhesive layer applied to the cards has an outside perimeter smaller than the outside perimeter of the photograph. The adhesive can be applied with adhesive transfer tape available through 3M. The adhesive transfer tape can be applied manually or with a spot applicator available from 3M.

The adhesive-transfer tape's release sheet is removed after applying the adhesive transfer tape to the card.

A single release sheet is applied over the adhesive. This single release sheet should first be cut to the desired shape and size. A set of dies is probably the most efficient way to perform such cutting.

The release sheet tapers to form a tab. The release sheet is applied to the adhesive and folded back upon itself. A template is laid across the top of the card.

The templates are usually made of a transparent material in sheet form, such as polyester. Guide lines can be printed on these transparent sheets using a photocopier.

A sheet containing a representation of the guide lines is used as a master. A copy of the guide lines on this sheet is printed onto the transparent polyester sheet using a photocopier. The templates are then cut from this transparent polyester sheet.

Light-tack, pressure-sensitive adhesive is applied to each template using a manual dispenser. The light-tack, pressure-sensitive adhesive is supplied on the adhesive transfer tape. As the adhesive transfer tape is run along the top edge of the template, the adhesive releases from the transfer tape and adheres to the polyester sheet. The template is then positioned over the card in the appropriate location and pressed into adhesive contact with the card.

Pressure-sensitive adhesives are initially provided in many different forms. Each form requires different application methods. The liquid form can be sprayed on. Some types can be applied with silkscreens. Hot-melt, pressure-sensitive adhesives must be heated in order to be applied. Hot-melt adhesive can be purchased from National Adhesives Singapore. Guns for heating and applying hot-melt adhesives can be purchased from 3M. Many envelope manufacturers use hot-melt, pressure-sensitive adhesives to glue the various flaps of the envelopes together. Hot-melt pressure sensitive adhesive can be applied to a single card with a hot-melt gun.

Release sheets come in a wide variety of materials. Methods for combining release sheets with pressure-sensitive adhesive include manual applications and the methods commonly used to manufacture labels. Existing machinery can easily be modified to automate the process of applying release sheets onto mounts in the desired location.

Operation—FIGS. 1 to 3

The mount of FIGS. 1 to 3 is intended for a picture P which is viewed in the horizontal position. Picture P is positioned on top of release sheet 118. The top edge of picture P is positioned under the edge of template 54. Picture P is then located within guide lines 50. The two side edges of picture P are located as closely as possible to the corresponding guide lines running parallel to the edges of picture P.

The picture is then positioned an equal distance from the corresponding guide lines running along the top. Pressure is directed down through template 54 toward mount M, at the top edge of picture P. This pressure is applied above release sheet 118 line 42, as illustrated by the thumb of a left hand. This holds picture P in position relative to mount M.

Tab 116 is then grasped and pulled down and away from mount M. This rolls and peels release sheet 118 back upon itself, out from beneath picture P and off mount M.

A clean piece of paper may be used to cover picture P and protect it from any oil on the user's hands. Smooth, even pressure is applied to the surface of the picture. This insures good contact with adhesive AD. The pressure directed down onto template 54 can now be stopped. Template 54 is now grasped and peeled off mount M. The removal of template 54 removes all adhesive LAD from mount M.

Operation—FIG. 6A

To remove template 52 of FIG. 6A, tab 44 is grasped and pulled up and away from mount M.

Operation—FIGS. 7A and 7B

Picture P is positioned on top of release sheet 112. The top edge of picture P is positioned under the bottom edge of template 56. Picture P is then located as desired. Picture P is positioned to suit the aesthetics of mount M. Pressure is directed down through template 56 toward mount M. Pressure is applied to the top edge of picture P, beyond the perimeter of the underlying release sheet. This holds picture P in position relative to mount M.

Tab 110 is then grasped and pulled down and away from mount M. This rolls and peels release sheet 112 back upon itself, out from beneath picture P and off mount M. Smooth, even pressure is applied to the surface of picture P to ensure good contact with adhesive AD. The pressure directed down onto template 56 can now be stopped. Template 56 is now grasped and peeled off mount M, thereby removing all adhesive LAD from mount M.

Operation—FIGS. 8A and 8B

To use the mount of FIG. 8A, a picture P is positioned on top of release sheets 106A and 106B. Picture P is positioned as desired relative to mount M. Pressure is applied down onto picture P directed toward mount M. In this illustration a left hand H is used to apply the pressure over release sheet 106B. Tab 104A is grasped with a right hand H and pulled up and directly away from mount M. The removal of release sheet 106A exposes adhesive AD to picture P. Release sheet 106A is set aside or discarded. The left hand continues to hold picture P in place. The right hand presses picture P down into contact with the exposed adhesive AD. Even pressure is applied over this area.

Mount M is now held in place with the right hand. The left hand is used to remove release sheet 106B. Tab 104B is grasped and pulled down and directly away from mount M. This removes release sheet 106B which is put aside or discarded. Pressure is then applied to press the remainder of picture P down into contact with adhesive AD.

Operation—FIGS. 9A and 9B

To use release sheet 100, adhesive AD must be exposed on one side. If release sheet 100 is provided on a backing release sheet 102 FIG. 9C, it must first be removed. To remove release sheet 100 from the backing release sheet, the second section of release sheet 100 is grasped around the area of perforation 98 and pulled up and away from backing release sheet 102.

Release sheet 100 is then releasably adhered onto a mount or onto a object.

Adhering Release Sheet 100 of FIG. 9A Onto a Mount

If release sheet 100 is adhered onto a mount M, a object to be adhered is positioned over top of release sheet 100. Object O is then moved about until it is positioned as desired. Object O is held in place. Object O is held beyond the perimeter of release sheet 100 above fold line 36. This insures that there is no pressure directed onto release sheet 100. Pressure directed onto release sheet 100 would create friction, thereby making its subsequent removal difficult.

Release sheet 100 is removed by pulling handle 94 down and away from adhesive AD. It is pulled in the direction opposite to where object O is being held. Pulling handle 94 pulls perforation 98 which rolls and peels release sheet 100 back upon itself. This pulls release sheet 100 out from under object O and off adhesive AD. The adhesive is left on mount M. Object O is then pressed into contact with adhesive AD.

Adhering Release Sheet 100 of FIG. 9A Onto An Object

If release sheet 100 is releasably adhered onto a object O, an edge or end of object O must be left uncovered by this release sheet. The uncovered edge or end must be above where the release sheet's fold line 36 is located. Object O is positioned over the surface of mount M. Object O is then moved about until it is positioned as desired and held in place beyond the perimeter of release sheet 100 at the end above fold line 36. This insures that there is no pressure directed onto release sheet 100. Release sheet 100 is removed by pulling handle 94 down and directly away from the adhesive in the direction opposite to the position of fold line 36. It is pulled in the direction opposite to where it is being held. Pulling handle 94 pulls hook 96 which pulls perforation 98. Release sheet 100 is rolled and peeled back upon itself, out from under object O and between object O and mount M. The adhesive layer is left on object O. Object O is then pressed into contact with adhesive AD.

Hook is Reusable

Hook 96 is detachable from perforation 98 of release sheet 100. Hook 96 is reusable with other suitable release sheets.

Operation—FIGS. 10A and 10B

Picture P is placed upon release sheet sections 92A and 92B. Picture P is positioned on mount M using guide lines 88 as a reference. Pressure is directed onto picture P over release sheet section 92A, toward mount M. This pressure immobilizes picture P relative to mount M. Corner 90B is grasped, bent, and peeled back upon itself, toward the bottom of mount M. Corner 90B is pulled down and off the end of mount M. Corner 90B is then pulled away from mount M at about a forty five degree angle, crossing the mount in the direction of the opposing corner of release sheet 92B and off mount M.

When release sheet 92B is completely removed, it is discarded. Picture P is then pressed down into contact with exposed adhesive AD. This secures the position of picture P relative to mount M. Corner 90A is now grasped, bent, and peeled back upon itself, toward the top of mount M. Corner 90A is pulled up and off the end of mount M. Corner 90A is then pulled away from mount M at about a forty five degree angle, crossing the mount in the direction of the opposing corner of release sheet 92A and off mount M. When release sheet 92A is completely removed, it is discarded. Picture P is now pressed into contact with the exposed adhesive.

Operation—FIGS. 11A and 11B

Picture P is placed upon release sheet sections 114A and 114B, as desired relative to mount M, and held in place. Pressure is applied onto picture P over either release sheet section. Both release sheet sections 114A and 114B are of the same shape and size and perform identical functions. For purposes of illustration, in this example pressure is applied onto the area of picture P overlying release sheet section 114A.

Release sheet section 114B is removed by grasping, bending, and rolling corner 86B back upon itself and down beyond the perimeter of mount M. Corner 86B is then pulled away from mount M at about a forty-five degree angle, crossing the mount in the direction of the opposing corner of release sheet 114B and off mount M. When release sheet 114B is completely removed, it is discarded. Pressure is applied over the surface of picture P which presses picture P into contact with exposed adhesive AD. Picture P is now secured in position relative to mount M. Release sheet 114A is now removed. Mount M is held in place by applying pressure down onto the surface of picture P over or around the area previously occupied by release sheet 114B, at the opposite end of mount M from which release sheet 114A was removed. Release sheet 114A is removed in the same manner as release sheet 114B.

When release sheet 114A is completely removed, it is discarded. Pressure is applied over the surface of picture P. This pushes picture P into contact with the remaining exposed adhesive AD.

Operation—FIGS. 12A to 13

Picture P is placed upon mount M, positioned as desired, and held in place. Pressure is applied down onto the surface of picture P in the direction of mount M. The pressure is isolated over one of the release sheet sections.

For the purpose of illustration, in this example, the pressure is isolated over release sheet section 80B. While picture P is held in place, release sheet section 80A is removed. Release sheet section 80A is removed by grasping tab 78A, which is rolled over upon itself using the fingers of one hand. The end of tab 78A is pulled up toward the top of mount M, as illustrated in FIG. 12A, which folds and rolls release sheet 80A back upon itself. Release sheet section 80A folds back upon itself and forms about a forty-five degree angle along diagonal line 84. When release sheet section 80A is completely removed, it is discarded. Picture P overlying exposed adhesive AD is pressed down into contact with adhesive AD. The remaining release sheet section 80B is removed in the same fashion.

Pressure is applied onto mount M on or around the area previously occupied by release sheet section 80A. The pressure is applied at the opposite end of release sheet section 80B. Release sheet section 80B is removed by grasping tab 78B. Tab 78B is rolled over upon itself with the fingers of one hand and pulled up toward the top of mount M. As tab 78B is pulled release sheet section 80B is folded and rolled back upon itself and forms about a 45 degree angle fold line. When release sheet section 80B is completely removed, it is discarded. Picture P is pressed down into contact with the remaining exposed adhesive AD.

Operation—FIGS. 14 to 16

To adhere a picture P onto a mount and mat assembly of FIG. 14 to FIG. 16, picture P is positioned as desired across the top of release sheets 66 to 76. Mat MT is positioned on top of picture P, overlying mount M. This is done to insure that the final position of picture P suits the aesthetics of the mat and mount. Picture P is repositioned if required. Mat MT is removed from mount MT and put aside. Picture P is held in place at one end of mount M mount M. Pressure is applied to the surface of picture P. The Pressure may be applied directly with one's hand, onto the surface of picture P, in the direction of mount M.

In this illustration the pressure is applied in the area of the release sheets 66, 68, and 70. Release sheets 76, 74, and 72, are pulled part way off mount M by grasping and pulling tabs 77, 75, and 73, preferably in sequence. The tabs are pulled directly away from mount M. A small portion of underlying adhesive AD is exposed.

Picture P is pressed down into contact with exposed adhesive AD. Picture P should now remain in place relative to mount M.

Remaining release sheet sections 66, 68, and 70 are pulled completely off mount M, exposing the underlying adhesive. Picture P is smoothly and evenly pressed in a downward outward motion. Picture P is gradually pressed down into contact with the exposed adhesive AD.

Mat MT is now placed over top of mount M and picture P, positioned as desired relative to picture P. Mat MT is held in place relative to mount M. All release sheets are now completely removed from mount M, preferably in a sequential order. Pressure is applied to the entire area of picture P and mat MT.

A picture P produced on a flexible material may require smooth even pressure directed from the centre of the picture toward the outside edges. This pushes picture P into smooth even contact with exposed adhesive AD.

The edges of mat MT are now pressed down toward mount M. This ensures that mat MT is adhered to the exposed adhesive of mount M.

Operation—FIGS. 17A and 17C

To use decal 62 of FIG. 17A, the decal is located as desired on the surface of mount M. The outside edges of release sheet sections 64A and 64B may be used to orientate decal 62 equidistant from the corner edges of mount M. In this illustration, the top edges of release sheet sections 64A and 64B and the outside edge of release sheet section 64B abut the corner edges of mount M.

Digital pressure is applied to one side of the back face of decal 62, toward the underlying mount. This pressure holds decal 62 stationary relative to mount M. The digital pressure may be applied over either one of the release sheet sections. For the purpose of this illustration, the digital pressure is applied over the area of decal 62, covering release sheet 64A. No pressure is applied to release sheet 64B.

The bottom inside corner of release sheet 64B abuts release sheet 64A. This corner 64B is grasped and bent away from decal 62. Corner 64B is bent back toward mount M. It is then folded back upon itself. It is pulled and peeled back upon itself and out from under decal 62. While removing release sheet 64B from adhesive AD layer, the tack of adhesive AD pulls decal 62 toward mount M. As release sheet 64B is removed, decal 62 and its adhesive AD layer bend and arc toward and into contact with mount M. A smooth even adhesion results between decal 62 and mount M.

The bottom inside corner of release sheet 64A is now grasped. This corner 64A is bent away from decal 62, back toward mount M. It is then folded back upon itself and pulled and peeled out from under decal 62. While removing release sheet 64A from adhesive AD layer, the tack of adhesive AD pulls decal 62 toward mount M. As release sheet 64A is removed, decal 62 and its adhesive AD layer bend and arc toward and into contact with mount M. A smooth even adhesion results between decal 62 and mount M. Decal 62 is now adhered to mount M. The release sheets are discarded.

Operation—FIGS. 18 to 20

To adhere decal 58 onto mount M, decal 58 is placed over the surface of mount M. Decal 58 is moved about until it is positioned as desired relative to mount M. Decal 58 is held in place on mount M. Pressure is applied to one side of decal 58. Either side may be used. The pressure is usually applied with the fingers of one hand. The pressure is applied onto decal 58 in the direction of mount M.

For the purpose of illustration, pressure is applied onto decal 58 over release sheet 59A. Tab 60B is grasped with right hand H and pulled directly away from decal 58. Then release sheet 59B is pulled, rolled, and peeled back upon itself. Release sheet 59B is pulled out from under decal 58. As release sheet 59B is removed from adhesive AD adhered onto decal 58, the adhesive tack pulls decal 58 down to the surface of mount M. Adhesive AD secures decal 58 to mount M. The same procedure is used to remove release sheet 59A.

Release sheet 59A is now removed. Tab 60A is grasped with the left hand and pulled directly away from decal 58. Then release sheet 59A is pulled, rolled, and peeled back upon itself. Release sheet 59A is pulled out from under decal 58. As release sheet 59A is removed from adhesive AD adhered onto decal 58, the adhesive tack pulls decal 58 down to the surface of mount M. Adhesive AD secures decal 58 to mount M. Decal 58 is now adhered onto mount M.

Operation—FIGS. 21A and 21B

To adhere object O onto mount M, of FIG. 21A, object O is placed over the surface of mount M, positioned as desired relative to mount M. A hard, rigid surface on object O can make removal of the release sheets a bit more complicated. There should be no pressure over the area of the release sheet being removed. There should be as little friction as is possible on the release sheets. This will help in their removal.

Object O is held in place. Object O may have to be tipped up slightly on the end opposite to the end from which the release sheet is being removed. For the purpose of illustration, release sheet 34B will be removed first. Tab 32B is grasped with one hand and is pulled directly away from mount M. As tab 32B is pulled, it pulls, rolls, and peels release sheet 34B off object O. Release sheet 34B is pulled out from under object O, and out from between object O and mount M. Release sheet 34B is discarded. The adhesive layer is exposed by the removal of release sheet 34B.

Object O is held in a fixed orientation relative to mount M while the end of object O with the exposed adhesive is pushed into contact with mount M.

Tab 32A is grasped with one hand and pulled directly away from mount M. As tab 32A is pulled, it pulls, rolls, and peels release sheet 34A off object O. Release sheet 34A is pulled out from under object O and out from between object O and mount M. Release sheet 34A is discarded. Remaining adhesive AD layer is exposed by the removal of release sheet 34A. Object O is then pressed into contact with mount M.

Summary, Ramifications, and Scope

From the descriptions above, a number of advantages of my adhesive mounts become evident:

Accordingly, the reader will see that the adhesive mount and method can be used in a wide variety of applications. The mount and method can be used on any solid surface on which a flat flexible sheet can be adhered.

(a) Photographs are easily and smoothly pressed into contact with exposed adhesive eliminating marring of the photographs surface.

(b) The mounting of photographs onto flat picture mounts does not require that the photographic paper be stretched and marred.

(c) The photograph is never grasped and bent sharply away from the mount, thereby eliminating these damaging forces.

(d) The mounts use a minimal amount of materials, which reduces weight, cost, and waste.

(e) Extreme accuracy is not required in the placement of release sheets, since a temporary template with guide lines is usually provided.

(f) The use of transparent release sheets and transparent adhesive will not visually obscure or distract in the accurate placement of the pictures on the mounts.

(g) The use of transparent release sheets and transparent adhesive will not distract from the aesthetics of the mounts.

(h) The use of transparent release sheets and transparent adhesive allows the viewing of instructions, symbols, or other illustrations beneath the adhesive and the release sheets.

(i) Temporary templates are adhered onto the picture mounts by a light adhesive which will not run and shift relative to the mounts.

(j) The mounts are simple, inexpensive, and easy for unskilled persons to use.

(k) The mounts provides great accuracy in the positioning and adhesion of objects onto mounts.

(l) Objects are located relative to the mounts prior to exposing the adhesive which eliminates accidental adhesion.

(m) The mounts provides the apparatus for accurately positioning and adhering photographs of varied sizes onto the mounts.

(n) Pictures can be viewed on the adhesive picture mounts before they are adhered.

(o) By using textured paper for the picture mounts, photographs adhered thereon are emphasized.

Pressure-sensitive adhesive is covered by thin, flexible release sheets. These release sheets are thin enough and flexible enough to be peeled out from between the two surfaces which are to be adhered. In one format, the adhesive is supplied on the mount and is covered by the release sheet. This isolates the adhesive from premature contact with the object.

In the other format, the adhesive is supplied on the object and is covered by the release sheet. This isolates the adhesive from premature contact with the mount.

A tab or edge extends beyond the perimeter of the release sheet sections covering the adhesive. The tab or edge also extends beyond and beneath the object to be adhered. When the object is positioned upon the mount as desired the release sheet sections are peeled out from between the object and the mount.

When a flexible object is equipped with a layer of pressure sensitive adhesive, the subsequent removal of the release sheets will pull the object down into adhesive contact with the mount.

It should be understood that the pressure-sensitive adhesive may be applied in lines, dots, squares, or any other combination of shapes or sizes. Double-stick-sided tape may also be used in place of a single layer of pressure sensitive adhesive. Double-stick-sided foam patches could be used in place of a single-adhesive layer. The adhesive layer may be applied to a portion of the object's surface or mount's surface, or to the object's entire surface. The face of decals may receive a layer of adhesive on its back or on its face. When the face of a decal receives a layer of adhesive the decal usually is adhered face down onto a transparent mount. When the back of a decal receives a layer of adhesive, the decal usually is adhered face up on a mount. The shapes of the release sheets should not be limited by the above examples. Any number of release sheets in any number of various shapes and sizes will perform the intended function.

The adhesive layer may also be positioned between two release sheets. One release sheet releases from the adhesive more readily than the other release sheet. The release sheet is removed from one side of the adhesive layer. A tab on the release sheet is unaffected by the adhesive. The exposed adhesive is adhered to a surface. The tab attached to the remaining release sheet is folded back upon itself and extends beyond the perimeter of the object to be adhered.

Picture mounts include a layer of pressure-sensitive adhesive. The adhesive is covered by a release sheet. The adhesive and release sheets are preferably clear. Since the release sheets are colorless, they will not clash with the colors of the mount.

When printing colors on the picture mount, instructions and illustrations can be printed on the mount at the same time. The clear adhesive layer can be applied over these instructions and illustrations. The clear release sheet can be applied over the clear adhesive. This eliminates the need to print additional sheets with this information. This information is immediately visible to any person looking at the mount. The picture is later adhered over top of the instructions. This is a efficient way to provide consumer information. Printing costs are reduced by utilizing space and material that would ordinarily be overlooked.

The principle common to all the variations of these adhesive mounts is the use of a pressure sensitive adhesive which is always covered by at least one thin flexible release sheet. Every thin, flexible release sheet has a tab, edge, or other removal means which extends beyond the perimeter of the object to be adhered. Guiding elements may be present. These guiding elements may be on the release sheet sections, on the mount, in the shape of the release sheet, or come with a separate template. The surface of the mount can be of any material to which adhesive will adhere. The adhesive can have a variety of properties. It can be opaque or transparent. It can be reinforced with fibres, such as glass or carbon. It can be high tact or a low tact repositionable adhesive. Its initial application may be in the form of a double-stick sided tape, an adhesive transfer tape, a spray adhesive, a liquid adhesive, a hot-melt adhesive, a contact adhesive or any other form of adhesive which will adhere on contact and releases from a release sheet.

The release sheets must be flexible and capable of assuming a relatively thin form.

The release sheets can be made of any suitable material such as paper, polyethylene, polyester, cloth, metal, or animal or vegetable products. The release sheets can take any shape which will cover the adhesive while allowing a removal element to extend beyond the perimeter of the object to be adhered. The release sheets may incorporate one or more materials of various shapes or thicknesses. The release sheets can be opaque, transparent, or have opaque and transparent areas. They will usually be treated with a release agent and may be made of wax, silicone, plastic polymer, or any other suitable material.

The release sheet can taper to form tabs. The tabs can have holes, perforations, nobs, or ridges. The tabs can be used to remove the release sheets.

There will be at least one release sheet, but many release sheets can be used. The adhesive can be applied first onto the release sheet and then brought together onto the object or onto the mount. The adhesive can be applied first onto the mount or onto the object and then be covered with the release sheet. Any release sheet section can contain guiding elements. The templates can be made of any material. They are preferably transparent or have transparent areas. An opaque template would work for mounting objects if some of the edges of a template served as guides. A portion of the template can be cut out and a object positioned within this cut out area. Also, a picture can be placed on top of a opaque template and positioned with in guide lines visible on the top. The template can later be peeled out from under the unadhered edge of the picture. The templates can be used independently from the adhesive mount. The mount can take the form of a card. The card should be compatible with pictures.

In the preferred embodiment of FIGS. 1 to 7B, the single transparent release sheet covers a layer of transparent adhesive. The template accommodates pictures of slightly varied sizes. The template and release sheet are easy to use. This is a ideal mount for use on greeting cards and postcards. It is perfect for use with photographs developed at photofinishing and photoprocessing stores. Standard sizes of photographic prints are available, but the mechanisms that cut the exposed photographic paper to predetermined lengths often slip during use. The result is photographs with slightly varied sizes from one processor to the other. This adhesive picture mount turns these irregularities into an asset.

Although the description above contains many specificities, these should not be construed as limiting the scope of the invention but as merely providing illustrations of some of the presently preferred embodiments of this invention. Other variations are possible.

Thus the scope of the invention should be determined by the appended claims and their legal equivalents, rather than by the examples given.

What is claimed is:

1. A mount for mounting an object, said mount comprising:

(a) a surface;

(b) a pressure-sensitive adhesive distributed on said surface;

(d) a flexible release sheet having a first portion detachably affixed to and covering said adhesive, said first portion being bounded by a peripheral edge and a fold line, said release sheet having a second portion comprising a free end, said free end doubled back along said fold line toward said peripheral edge over said first portion of said release sheet; and (e) a member connected to said free end and extending from said free end entirely across said first portion and crossing said peripheral edge at a point opposed to said fold line, said member having a graspable end extending beyond said peripheral edge;

whereby said first portion of said release sheet may be peeled off from said adhesive by pulling on said graspable end of said member in a direction away from said fold line and said peripheral edge and generally parallel to said surface.

2. The mount of claim 1 wherein said member comprises an integral extension of said free end.

3. The mount of claim 2 wherein said free end is tapered in width toward said graspable end.

4. The mount of claim 1 wherein said member further comprises a connector for detachably affixing said member to said free end.

5. A Mount for mounting an object, said mount comprising:

(a) a surface;

(b) a mounting area on said surface, said mounting area having at least one peripheral edge;

(c) a pressure-sensitive adhesive distributed on an area of said mounting area;

(d) a flexible release sheet covering said mounting area, said release sheet having a first portion detachably affixed to said adhesive and a second portion comprising a free end not affixed to said adhesive, said free end doubled back toward said edge upon said first portion of said release sheet; and (e) a member connected to said free end and extending across said edge from said free end, said member having a graspable end; and (f) a template releasably affixed to said surface next to said mounting area;

whereby said first portion of said release sheet may be peeled off from said adhesive by pulling on said graspable end of said member in a direction away from said edge and generally parallel to said surface.

6. The mount of claim 5 further comprising a plurality of guiding elements on said template.

7. The mount of claim 6 wherein said template comprises a transparent area.

8. The mount of claim 5 wherein said template is releasably affixed to said surface by a releasable adhesive distributed on a portion of said template and said template is unaffixed in a portion overlapping said mounting area.

9. The mount of claim 1 further comprising:

(a) a second surface;

(b) a second pressure-sensitive adhesive distributed on said second surface;

(c) a second flexible release sheet having a first portion detachably affixed to and covering said second pressure-sensitive adhesive, said first portion of said second release sheet being bounded by a second peripheral edge and a second fold line in abutment with said fold line, said second release sheet having a second portion comprising a second release sheet free end, said second release sheet free end folded back along said second fold line toward said second peripheral edge, over said first portion of said second release sheet; and (d) a second member connected to said second release sheet free end and extending from said second release sheet free end entirely across said first portion of said second release sheet and crossing said second release sheet peripheral edge at a point opposed to said second fold line, said second member having a graspable end extending beyond said second peripheral edge from said second release sheet free end.

10. An object adapted for mounting on a mounting surface, said object comprising:

(a) a first surface having a perimeter;

(b) a pressure-sensitive adhesive on said first surface;

(c) a flexible release sheet having a first portion detachably affixed to and covering said adhesive, said first portion being bounded by a peripheral edge and a fold line, said release sheet having a second portion comprising a free end, said free end folded back along said fold line toward said peripheral edge over said first portion of said release sheet; and (d) a member connected to said free end and extending from said free end entirely across said first portion and crossing said peripheral edge at a point opposed to said fold line, said member having a graspable end projecting outside of said perimeter, such that said graspable end is unobstructed by said object when said first surface is adjacent to said mounting surface;

whereby said first portion of said release sheet may be peeled off of said adhesive by pulling on said graspable end of said member in a direction away from said fold line and generally parallel to said first surface.

11. A mount for mounting an object, said mount comprising:

(a) a surface;

(b) a mounting area on said surface, said mounting area having at least one peripheral edge;

(c) a pressure-sensitive adhesive distributed on said mounting area;

(d) a flexible release sheet covering said mounting area, said release sheet having a first portion detachably affixed to said adhesive and a second portion comprising a free end, said free end doubled back toward said edge over said first portion of said release sheet; and (e) a template releasably hingedly affixed to said surface next to said mounting area in superimposable relation to said surface, said template comprising a guiding element for aligning an object with said mounting area.

12. The mount of claim 11, wherein said template comprises a transparent area.

13. The mount of claim 12, wherein said release sheet comprises a transparent plastic film.

14. The mount of claim 11, wherein said guiding element comprises an aperture in said template.

15. A Mount for mounting an object, said mount comprising:

(a) a surface;

(b) a mounting area on said surface;

(c) a pressure-sensitive adhesive distributed on said mounting area;

(d) a flexible release sheet covering said mounting area, said release sheet having a first portion detachably affixed to said adhesive and a second portion comprising a free end not affixed to said adhesive, said free end folded back over said first portion of said release sheet; and (e) a template releasably hingedly affixed to said surface next to said mounting area in superimposable relation to said surface, said template comprising a guiding element for aligning an object with said mounting area.

16. A mount comprising:

(a) a surface;

(b) a pressure-sensitive adhesive distributed on said surface;

(c) a flexible release sheet having a first portion detachably affixed to and covering said adhesive and having a second portion comprising a free end, said free end folded back upon said first portion of said release sheet;

(d) a member connected to said free end, said member having a graspable end; and (e) an object for mounting, the object being superimposed over said release sheet, said object having a perimeter, said graspable end of said member extending beyond said perimeter of said object;

whereby said first portion of said release sheet may be peeled off from said adhesive and removed out from under said object by pulling on said graspable end of said member, to allow said object to engage said pressure-sensitive adhesive.

17. The mount of claim 16 wherein said member comprises an integral extension of said free end.

18. The mount of claim 9 wherein:

(a) said release sheet and said second release sheet are substantially transparent; and, (b) said member and said second member comprise, respectively, integral extensions of said release sheet free end and said second release sheet free end, said members tapering towards said graspable ends thereon.

19. The mount of claim 1 wherein said release sheet is transparent, further comprising indicia on said mount beneath said release sheet, said indicia viewable through said release sheet.

20. The mount of claim 19 wherein said adhesive is transparent, and said indicia are on said surface beneath said adhesive.

21. The mount of claim 1 further comprising guiding elements to assist in locating an object on said mounting area.

22. The mount of claim 21 wherein said guiding elements comprise a plurality of guide lines on said release sheet.

23. The mount of claim 22, wherein said guide lines comprise pairs of lines parallel to edges of said release sheet and equally spaced from a center line of said release sheet.

24. The mount of claim 21, wherein said guiding elements comprise first and second sets of lines on said release sheet said first and second sets of lines being distinguishable from one another by identifying elements.

25. The mount of claim 24 wherein said identifying elements comprise different colors applied to said first and second sets of lines.

26. The mount of claim 24 wherein said identifying elements comprise different textures applied to said first and second sets of lines.

27. The mount of claim 24 wherein said identifying elements comprise different optical clarities applied to said first and second sets of lines.

28. The object of claim 10 wherein said release sheet comprises straight edges projecting past said perimeter for guiding placement of said object on said second surface.

29. The mount of claim 16 wherein said release sheet comprises straight edges projecting past said perimeter of said object for guiding placement of said object on said surface.

* * * * *